United States Patent [19]

Linthout

[11] Patent Number: 4,546,964

[45] Date of Patent: Oct. 15, 1985

[54] SHEET CONVEYING DEVICE

[75] Inventor: Theodoor H. Linthout, Grubbenvorst, Netherlands

[73] Assignee: Océ-Nederland B.V., Venlo, Netherlands

[21] Appl. No.: 460,268

[22] Filed: Jan. 24, 1983

[30] Foreign Application Priority Data

Feb. 1, 1982 [NL] Netherlands ..... 8200355

[51] Int. Cl.[4] ..... B65H 5/06; B65H 9/16

[52] U.S. Cl. ..... 271/250; 271/251

[58] Field of Search ..... 271/120, 314, 250, 251, 271/248, 119

[56] References Cited

U.S. PATENT DOCUMENTS

| | | | |
|---|---|---|---|
| 3,617,719 | 6/1972 | May | 235/61.11 D |
| 3,669,447 | 6/1972 | Turner et al. | 271/120 |
| 3,929,327 | 12/1975 | Olson | 271/250 |
| 4,359,219 | 11/1982 | Garayuso | 271/251 |

FOREIGN PATENT DOCUMENTS 1377846 12/1974 United Kingdom .

OTHER PUBLICATIONS

Xerox Disclosure Journal, vol. 4, No. 3, May/Jun. 1979, Hawkins et al., p. 327.

*Primary Examiner*—Bruce H. Stoner, Jr.
*Assistant Examiner*—James E. Barlow
*Attorney, Agent, or Firm*—Albert C. Johnston

[57] ABSTRACT

A device for conveying a sheet along a conveying path while bringing and/or holding an edge of the sheet against an abutment strip at one side of the conveying path comprises a friction member that rotates about an axis extending transversely over the conveying path and has flexible fingers each extending in a direction that is the resultant of an axial component directed toward the abutment strip and a tangential component in the direction of rotation of the friction member. A rotating finger contacting a sheet in the path will bend in such a way that its end is displaced in the sheet conveying plane in the direction toward the abutment strip to position the sheet against that strip, and then will bend so as to move its end off the sheet.

10 Claims, 9 Drawing Figures

SHEET CONVEYING DEVICE

This invention relates to a device for conveying sheets along a conveying path bordered by an abutment strip.

Devices of this kind are known, for advancing a sheet over the conveying path while bringing and/or holding an edge of the sheet in contact with the abutment strip, in which a friction member secured to a rotatable shaft extending transversely across the conveying path is provided with at least one flexible finger which, when the shaft rotates, traverses a surface of revolution that intersects the conveying path. Such devices are used, inter alia, in office equipment in which sheets of copy material, documents to be copied, punched cards, and the like are conveyed from a delivery station to a processing station. By being kept in contact with the abutment strip the sheets can always reach the processing station in the same position.

U.S. Pat. No. 3,671,719 discloses a device of the kind mentioned which makes use of a rotating friction member provided with radially extending resilient fingers. The friction member is so disposed that whenever a finger comes into contact with a sheet present in the conveying path the finger undergoes an elastic deformation as a result of which its free end is displaced axially and toward the abutment strip. The finger consequently exerts on the sheet a frictional force in the direction of its rotation to advance the sheet along the conveying path, while also exerting by the axial displacement of the free end a frictional force that displaces the sheet laterally in the direction toward the abutment strip. Sheets lying at an angle and sheets situated outside the required path of advance can be pressed against the abutment strip by the lateral movement and thus be brought into the correct position.

The distance over which a sheet can be displaced by the bending of a finger is of course dependent upon the length of the finger. Generally speaking the longer the finger the farther it can be bent and the farther it can displace the sheet sideways. Consequently, if the sheets supplied are very much at an angle, as is often the case in practice, the fingers used must be relatively long. This, however, has the disadvantage of requiring a bulky construction for the rotatable friction member.

Another disadvantage of that known device is that a finger which by elastic deformation first undergoes a displacement in the direction toward the abutment strip will, upon further rotation of the friction member, then undergo the same displacement in the opposite direction. Thus when two or more fingers simultaneously are in contact with the sheet some of the finger ends move toward and some move away from the abutment strip. This can result in the conveyed sheet being subjected to a torque that tends to move the leading portion of the sheet away from the abutment strip; so the desired positioning of a sheet against the abutment strip cannot always be achieved.

The principal object of the present invention is to provide a sheet conveying device of the kind hereinebfore mentioned which does not have the disadvantages mentioned above.

According to this invention, such a device comprises a friction member which is rotatable about an axis extending transversely over a conveying path for the sheets and is provided with at least one and preferably at least four flexible fingers which on rotation of the friction member traverse a surface of revolution that intersects the conveying path, and each finger extends in a direction that is the resultant of an axial component directed toward the abutment strip and a tangential component in the direction of rotation of the friction member. It has been found that in this way a friction member can be provided which will occupy little space yet can have relatively long fingers, so that even sheets lying very much at an angle can be positioned properly with prevention of the generation of torques that would move a sheet out of position.

In an advantageous embodiment of the invention, the friction member is so constructed that the surface of revolution traversed by each finger is the surface of a cone a straight line element of which intersects at an acute angle the direction of extension of the finger.

Other objects, features and advantages of the invention will become apparent from the following description in which reference is made to the accompanying drawings. In the drawings.

Figure 1:
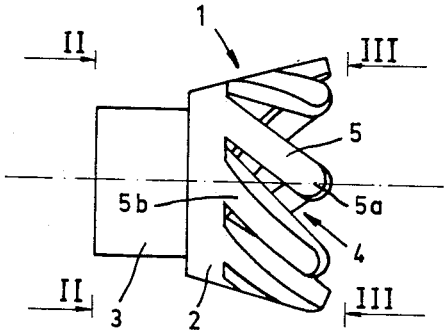
FIG. 1 is a side view of the friction member of a sheet conveying device according to a preferred embodiment of the invention.
Figure 2:
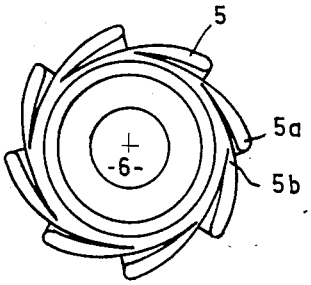
FIG. 2 is an end view of the friction member, taken at line II—II of FIG. 1.
Figure 3:
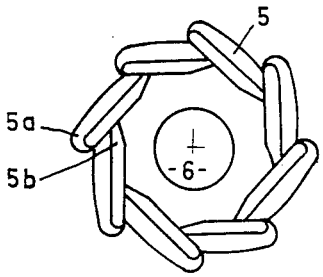
FIG. 3 is an end view thereof taken at line III—III of FIG. 1.

As shown in FIGS. 1, 2 and 3, the friction member 1 of a sheet conveying device according to the invention comprises a hollow body 2 having an outer surface in the form of a truncated cone the included angle of which is preferably about 30°, with a cylindrical hub 3 extending coaxially from that side of the conical body 2 which has the smaller diameter. From the side thereof having the larger diameter eight straight indentations or cutaway slits 4 are formed in the conical body 2 at regular intervals, thus providing eight protruding fingers 5 which have a rectangular cross section and normally lie on the surface of the cone. Each indentation and hence each of the fingers, protrudes at an angle of 45° relative to a straight line element of the cone passing through it. Each of the eight fingers 5 thus has a radial, an axial, and a tangential direction component relative to the axis of rotation of the friction member. The length of the fingers 5 is such that the free end 5*a* of one finger and the base 5*b* of an adjacent finger are situated on the same straight line element of the cone.

Figure 4:
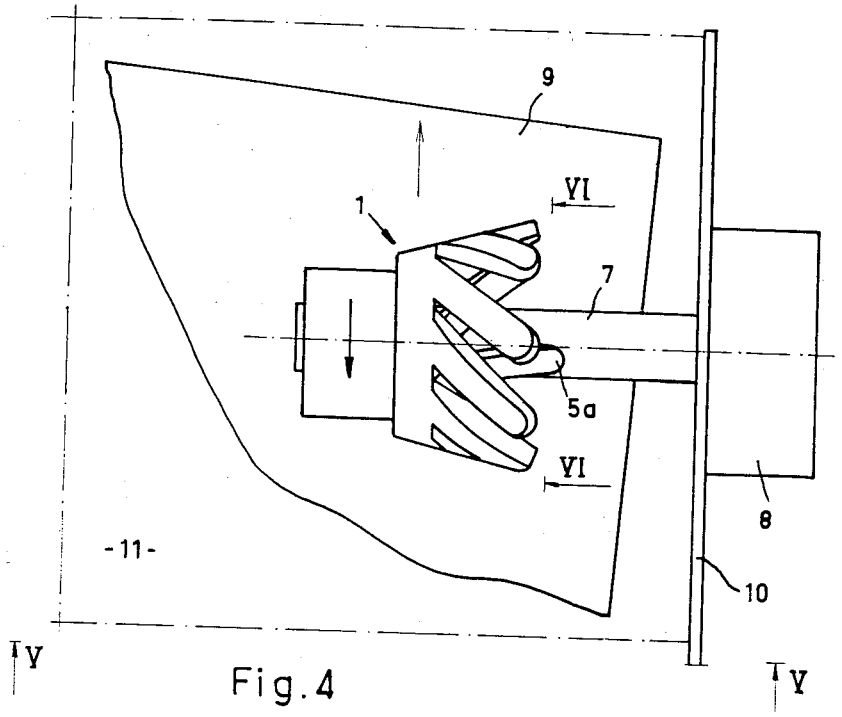
FIG. 4 is a top plan view of the sheet conveying device.
Figure 5:
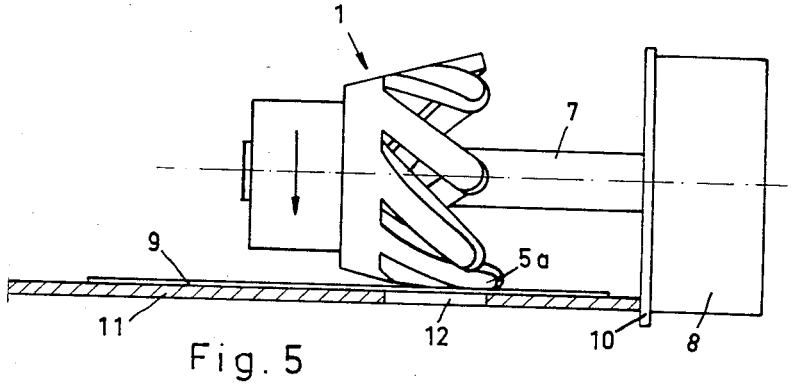
FIG. 5 is a side view of the device, partly in section, taken at line V—V of FIG. 4.

The cylindrical hub 3 is formed with a hole 6 through which a shaft 7 can be passed as shown in FIGS. 4 and 5, and the shaft 7 can be driven by a motor 8 to rotate the friction member. The friction member 1 is made of a resiliently deformable, or elastic, material such, e.g., as rubber.

As shown in FIGS. 4 and 5, the shaft 7 lies parallel to a panel 11 which forms a conveying path for sheets 9, and the shaft extends at a right angle relative to a sheet abutment strip 10 that borders and extends along the conveying path. The axis of the friction member 1 is disposed at such a distance from the panel 11 that the fingers 5 can come into frictional engagement with a sheet 9 present on the panel. The panel 11 is formed with an aperture 12 through which the fingers can pass without engaging against the panel if no sheet is present to be conveyed by the friction member.

Figure 6A:
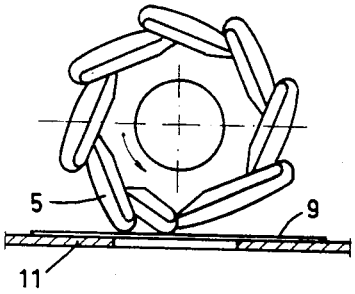
FIGS. 6A, 6B, 6C and 6D are end views thereof, partly in section, taken at line VI—VI of FIG. 4 but showing the friction member in different rotational positions.

In the position of the friction member as shown in FIG. 6A, the finger designated by numeral 5 is just about to come into contact with a sheet 9 present on the panel 11. On rotation of the friction member in the direction indicated by the arrow the relevant finger will be displaced in the desired direction of conveyance of the sheet, with its end engaged against the sheet, and as a result the finger 5 is bent in a direction perpendicular to the plane of movement of the sheet, i.e., upward as viewed in FIG. 6B. Due to the resilience of the finger, a force normal to the sheet will then be exerted on the sheet, by which the sheet can be advanced in a direction parallel to the abutment strip 10. At the same time, by reacting to the frictional force exerted on the sheet, the finger will experience a force and consequently will bend in a direction opposite site to the direction of advance of the sheet. This bending will cause the free end 5*a* of the finger to displace in axial direction, as shown in FIGS. 4 and 5, and thus to exert on the sheet a frictional force directed toward the abutment strip; so, on continuing movement of the finger in the direction of sheet advance, this frictional force will displace the sheet also in the direction toward the abutment strip in order to bring the sheet into and hold it in contact with said strip.

Figure 6B:
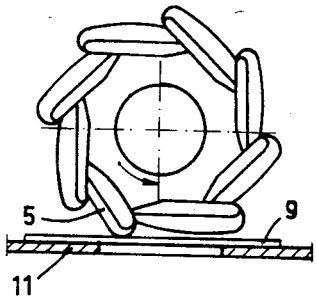

The continuing rotation of the friction member from the angular position shown in FIG. 6B causes the finger 5 to be bent further in the direction perpendicular to the sheet, so that an increasing force normal to the sheet is exerted on the sheet and hence an increasing frictional force in the forward direction.

Figure 6C:
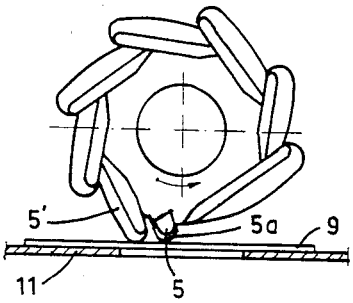

The frictional forces, or force components, in the forward direction and in the direction toward the abutment strip reach a maximum when, as shown in FIG. 6C, the free end 5*a* of the finger 5 comes into the vertical plane passing through the axis of rotation. In this position of the friction member the bending of the finger in the direction opposite to the direction of advance and hence also displacement of the sheet in the direction toward the abutment strip reach a maximum. Depending upon the frictional and resilient forces occurring, the finger in this position can extend substantially perpendicularly with respect to the abutment strip.

Figure 6D:
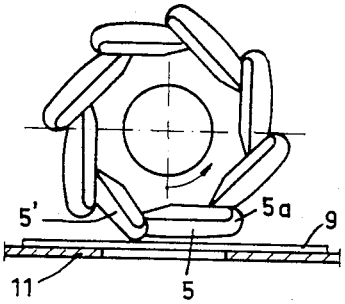

As the friction member is moved past the angular position shown in FIG. 6C, the bending of the finger 5 perpendicularly to the sheet decreases and consequently the force normal to the sheet and the frictional forces exerted on the sheet also decrease. Consequently, the reaction force exerted on the finger will decrease the the resilience or elasticity of the finger will turn the finger back to its initial position as shown in FIG. 6D. During this turn-back movement the free end 5a of the finger is held away from the sheet so that no force directed away from the abutment strip can be exerted on the sheet. As shown in FIG. 6D, a following finger 5 has in the meantime started the bending movement.

Although the invention has been described with reference to particulars of a preferred embodiment, it will be apparent that it can be embodied in devices having other forms within the principle and scope of the present disclosure. For example, the friction member can be disposed with its axis of rotation at an angle to the plane of the sheet conveying path. In such a case the angle of each finger may even be such that each finger will lie parallel to the axis; in other words the outer surface of the friction member may then be cylindrical.

It is also practicable to dispose a stop in the conveying path, transverse to the direction of advance of a sheet, so that forward movement of a sheet may be stopped even though frictional forces continue to be applied to the sheet by fingers of the friction member. In such a case, when a sheet is positioned both against the transverse stop and against the abutment strip parallel to the direction of movement, continuing rotation of the friction member will cause a finger or fingers to slip readily over the stationary sheet without creasing or rumpling the sheet between the finger and either the stop or the abutment strip.

According to another embodiment of the invention, instead of the friction member being made with resilient fingers the fingers may be rigid and be secured to a rotatable annular member so as to be freely pivotable, in such a way that each finger, at least when it comes into contact with a sheet, is held by a spring or by a stop on the annular member in a protruding position in which the finger has a radial, an axial, and a tangential direction component with respect to the axis of rotation. If such a rigid finger is not provided with spring means for returning it to that position directly after its frictional action has been performed on a sheet in the conveying plane, the annular member is provided with a stop, preferably radially directed, which lifts the finger from the sheet directly after the end of the finger has passed an axial plane perpendicular to the conveying plane.

What is claimed is:

1. A sheet conveying device comprising means forming a conveying path for sheets, a sheet abutment strip along a side of said path, and a rotatable friction member for advancing a sheet along said path while bringing an edge of the sheet into and/or holding such edge in contact with the abutment strip, said friction member being rotatable about a fixed axis extending transversely over the conveying path and being provided with at least one flexible elongate finger the central longitudinal axis of which extends substantially throughout the length of the finger in a direction that is the resultant of an axial component directed toward said abutment strip and a tangential component in the direction of rotation of said member, each said finger on rotation of said member about said fixed axis traversing a surface of revolution that intersects said path.

2. A sheet conveying device according to claim 1, said surface of revolution being the surface of a cone a straight line element of which intersects at an acuate angle said direction of extension of the finger.

3. A sheet conveying device according to claim 1 or 2, said friction member having at least four said fingers spaced apart regularly about said axis, said direction and the distance of extension of each finger being such that a plane containing said axis and extending through the base of a finger intersects the free end of an adjacent finger.

4. A sheet conveying device according to claim 2, each said finger extending at an angle of about 45° to a straight line element of the cone.

5. A sheet conveying device according to claim 1, said path forming means comprising a substantially flat sheet supporting panel having formed therein adjacent to said friction member an opening through which each said finger can pass freely when no sheet is present there to be conveyed by said member.

6. A sheet conveying device according to claim 1, said friction member being an annular body having a hub portion fixed to a shaft rotatable about said axis and having at least four said fingers each of which is formed of elastically deformable resilient material, said fingers each lying on a conical surface of revolution that is coaxial with said shaft and includes an angle of about 30°, and each said finger extending at an angle of about 45° to a straight line element of said conical surface.

7. A sheet conveying device comprising a friction member rotatable about a central axis thereof disposed transversely over a conveying path for sheets, for advancing a sheet along said path while bringing an edge of the sheet into and/or holding such edge in contact with an edge abutment strip along a side of said path;

said friction member comprising a hollow body portion made of elastic material, the outer surface of which describes a truncated cone, and a hub portion extending coaxially from the smaller diameter end of said body portion;

said body portion having a plurality of substantially straight elongate slits cut away from it at regular intervals about said axis, each from its larger diameter end to a smaller diameter base of said body portion and at an acute angle to a plane containing said axis and intersecting the slit;

said body portion comprising between said slits regularly spaced, elastically flexible, elongate fingers each of which normally lies at the surface of said cone and protrudes from said base with the central longitudinal axis of the finger extending substantially throughout the length of the finger at a substantially uniform acute angle relative to a plane containing said central axis and intersecting the finger; the ends of said fingers, on rotation of said friction member about said central axis, traversing a surface of revolution that intersects said conveying path.

8. A sheet conveying device according to claim 7, said fingers each having a substantially uniform rectangular cross section over its length from said base to nearly the end of the finger.

9. A sheet conveying device according to claim 7 or 8, said fingers each protruding at an angle of the order of about 45° relative to a said plane intersecting the finger, the included angle of said cone being of the order of about 30°.

10. A sheet conveying device according to claim 9, there being eight each of said slits and said fingers.

* * * * *